US007731314B2

(12) United States Patent
Kim

(10) Patent No.: US 7,731,314 B2
(45) Date of Patent: Jun. 8, 2010

(54) DOOR ASSEMBLY AND REFRIGERATOR USING THE SAME

(75) Inventor: Sang Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 365 days.

(21) Appl. No.: 11/260,152

(22) Filed: Oct. 28, 2005

(65) Prior Publication Data

US 2006/0226749 A1 Oct. 12, 2006

(30) Foreign Application Priority Data

Apr. 11, 2005 (KR) ..... 10-2005-0029931

(51) Int. Cl.
*A47B 96/04* (2006.01)

(52) U.S. Cl. ..... 312/402; 312/303

(58) Field of Classification Search ..... 312/401, 312/402, 404, 310; 62/440, 382; 248/284.1, 248/248; 108/145, 118
See application file for complete search history.

(56) References Cited

U.S. PATENT DOCUMENTS

| | | | | | |
|---|---|---|---|---|---|
| 709,245 | A * | 9/1902 | Scott | 254/2 C |
| 846,105 | A * | 3/1907 | Harris et al. | 108/122 |
| 2,819,141 | A * | 1/1958 | Myer | 312/303 |
| 3,647,165 | A * | 3/1972 | Whitla | 244/118.5 |
| 4,558,648 | A * | 12/1985 | Franklin et al. | 108/147 |
| 5,193,649 | A * | 3/1993 | Lee | 187/244 |
| 2004/0183415 | A1* | 9/2004 | Kim | 312/402 |
| 2005/0073225 | A1* | 4/2005 | Kwon et al. | 312/402 |
| 2005/0144970 | A1* | 7/2005 | Cho et al. | 62/441 |

FOREIGN PATENT DOCUMENTS

| | | | |
|---|---|---|---|
| JP | 5-296647 | A | 11/1993 |
| JP | 5296647 | * | 11/1993 |
| KR | 1998-026269 | A | 7/1998 |
| KR | 2001-0028446 | A | 4/2001 |
| KR | 10-2004-0082700 | A | 9/2004 |

OTHER PUBLICATIONS

Translation of JP 5,296,647.*

* cited by examiner

*Primary Examiner*—Janet M Wilkens
*Assistant Examiner*—Matthew W Ing
(74) *Attorney, Agent, or Firm*—Birch, Stewart, Kolasch & Birch, LLP

(57) ABSTRACT

A refrigerator includes a body, a compartment within the body, a container within the compartment, a door movable along a first direction with respect to the body and rotatable along a second direction, and a lifting mechanism supporting and elevating the container when the door rotates along the second direction. The lifting mechanism includes a hinge connecting the door with a frame connected with the rail assembly and allowing the door to rotate in the second direction, and at least one lifting bars coupled to the door and supporting and elevating the container when the door rotates about the hinge in the second direction.

20 Claims, 3 Drawing Sheets

DOOR ASSEMBLY AND REFRIGERATOR USING THE SAME

This Non-provisional application claims priority under 35 U.S.C. §119 (a) on Patent Application No. 10-2005-0029931 filed in Korea on Apr. 11, 2005, the entire contents of which are hereby incorporated by reference.

BACKGROUND OF THE INVENTION

1. Field of the Invention

The present invention relates to a door assembly for a refrigerator, and more particularly, to a mechanism for elevating a container of a refrigerator when a door is open.

2. Discussion of the Related Art

Conventional refrigerators are usually classified into three types, i.e., a top mount freezer type, a side by side type, and a bottom mount freezer type. In the top mount freezer type refrigerator, a freezing compartment is provided at an upper portion of the refrigerator and a refrigerating compartment is provided at a lower portion of the refrigerator. In the side by side type refrigerator, a freezing compartment and a refrigerating compartment are respectively arranged on a left portion and a right portion of a refrigerator. In the bottom mount freezer type refrigerator, a freezing compartment is provided at a lower portion of the refrigerator and a refrigerating compartment is provided at an upper portion of the refrigerator.

Each compartment of the refrigerator is generally opened and closed by a door coupled to a body of the refrigerator. The door and the body of the refrigerator are usually coupled by a hinge so that the door can rotate with respect to the body in order to open and close the compartment of the refrigerator.

Meanwhile, it is very uncomfortable for the user to use the freezing compartment mounted at the lower portion of the refrigerator when the door is simply open by rotating about the hinge because the user has to kneel and bend his/her body and stretch his/her hands into an inside of the freezing compartment mounted at the lower portion of the refrigerator.

SUMMARY OF THE INVENTION

Accordingly, the present invention is directed to a door assembly and a refrigerator using the same that substantially obviates one or more problems due to limitations and disadvantages of the related art.

An object of the present invention is to provide a door assembly and a refrigerator using the same which can elevate a compartment provided at a lower portion of the refrigerator when the door is open for the user's convenience.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in one aspect of the present invention, a door assembly according to an embodiment of the present invention includes a door movable along a first direction with respect to a body of the refrigerator and rotatable along a second direction, and a lifting mechanism supporting and elevating a container provided in the body when the door rotates along the second direction.

The first direction may be a horizontal direction. An upper portion of the door may rotate downwardly about a lower portion of the door when the door rotates along a second direction.

The door assembly may further include a rail assembly connected with the body and the door assembly. The rail assembly may guide a movement of the door in the first direction.

The lifting mechanism may include a hinge connecting the door with a frame connected with the rail assembly and allowing the door to rotate in the second direction, and at least one lifting bar coupled to the door. The at least one lifting bar supports and elevates the container when the door rotates about the hinge in the second direction.

The frame may include a first end connected with an end of the rail assembly, and a second end extended downwardly from the first end, wherein the hinge is provided at the second end.

The lifting mechanism may further include a roller provided at the at least one lifting bars. The roller rolls on a bottom surface of the container when the door rotates in the second direction.

The container may further include a projection provided on a bottom thereof. The projection supports at least one lifting bar to prevent the container from falling downward when the container is fully elevated.

The hinge may be connected with a lower portion of the door and an upper portion of the door may be contacted with the rail assembly or the frame when the door moves in the first direction.

The door assembly may further include a limiter which selectively limits a rotation of the door in the second direction. The limiter allows the door to rotate in the second direction after the door is open.

The limiter may include a permanent magnet coupled to the rail assembly, wherein the permanent magnet holds an upper portion of the door. Alternatively, the limiter may include an electromagnet coupled to the rail assembly, wherein the electromagnet releases an upper portion of the door after the door is open.

In the other aspect of the present invention, a refrigerator according to an embodiment of the present invention includes a body, a compartment within the body, a container within the compartment, a door movable along a first direction with respect to the body and rotatable along a second direction, and a lifting mechanism supporting and elevating the container when the door rotates along the second direction.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
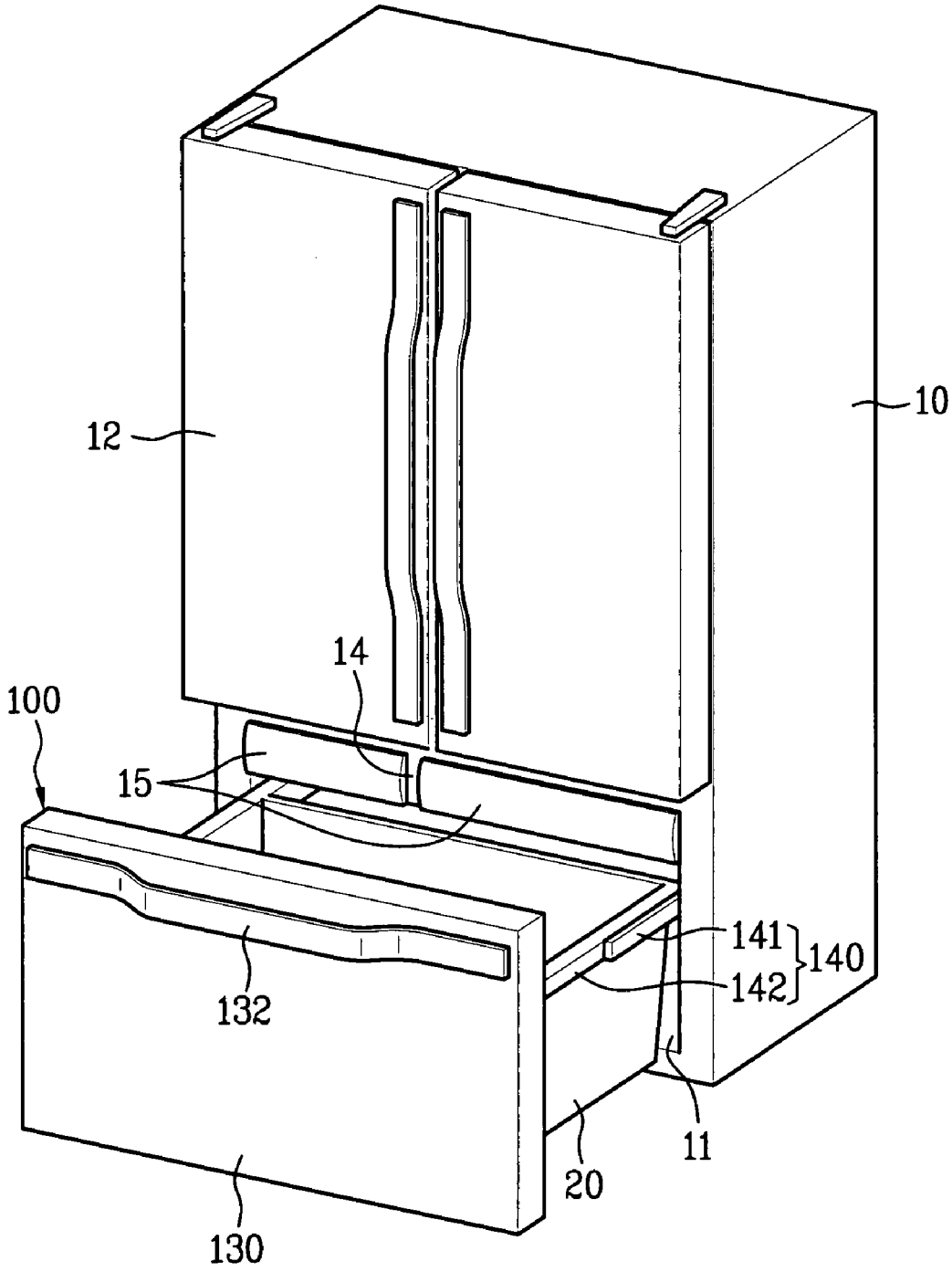
FIG. 1 illustrates a perspective view of a refrigerator according to an embodiment of the present invention.

Referring to FIG. 1, a refrigerator according to an embodiment of the present invention includes a body 10, compartments provided in the body 10, and door assemblies 12 and 100 for opening and closing the compartments. The compartments, for example, include a refrigerating compartment (not shown) provided in an upper portion of the body 10 and a freezing compartment 11 provided in a lower portion of the body 10. Alternatively, it is possible that the refrigerating compartment is located in the lower portion of the body 10 and the freezing compartment is located in the upper portion of the body 10.

A horizontal partition wall 14 divides an inside space of the body 10 into the refrigerating compartment and the freezing compartment 11. A mechanical component chamber (not shown) for accommodating a compressor, a condenser, etc. is provided in the lower portion of the body 10, especially at a rear side of the freezing compartment 11.

A pair of door assemblies 12 is coupled to the body 10 by a hinge. The door assemblies 12 rotate about the hinge with respect to the body 10 for opening and closing the refrigerating compartment. The door assembly 100 is provided at the lower portion of the body 10 for opening and closing the freezing compartment 11 at the lower portion of the body 10.

At least one container 20 for storing food therein is provided in the freezing compartment 11 at a lower portion of the freezing compartment 11, and at least one drawer 15 is provided above the container 20 in the freezing compartment 11 as shown in FIG. 1. The container 20 moves forward and backward with respect to the body 10 along with a movement of the door assembly 100 while the drawer 15 moves independent of the movement of the door assembly 100.

Figure 2:
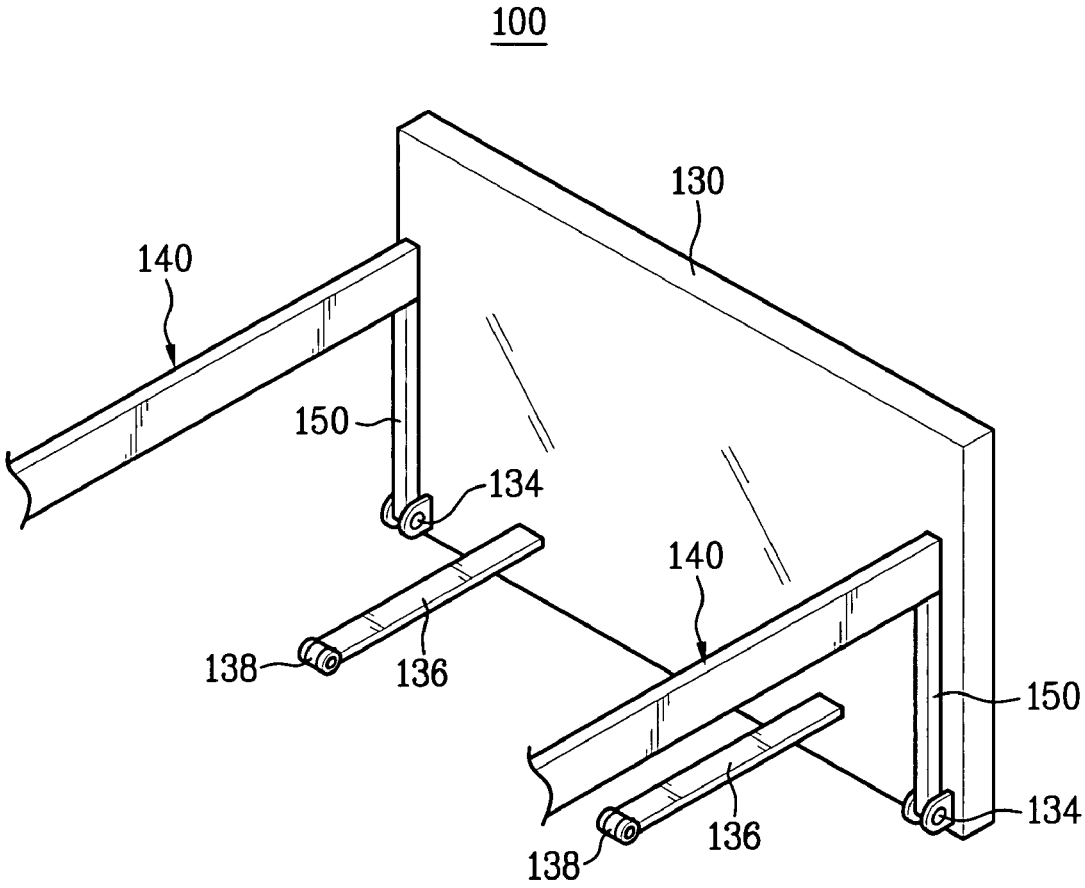
FIG. 2 illustrates a partial perspective view of a door assembly of FIG. 1 for elevating a container of FIG. 1.

For the user's convenience, the container 20 may be elevated after the door assembly 13 is open. For this, the door assembly 100 according to an embodiment of the present invention has a mechanism for elevating the container 20. FIG. 2 illustrates the mechanism of the door assembly 100 in detail. The detailed mechanism of the door assembly 100 will be described referring to FIG. 2.

As shown in FIG. 2, the door assembly 100 includes a door 130 for opening and closing the freezing compartment 11 and a lifting mechanism for supporting and elevating the container 20.

The door 130 moves along a first direction along with the door assembly 100 in order to open or close the freezing compartment 11. The first direction may be a horizontal and straight direction. For example, the door 130 may move forward and backward with respect to the body 10.

To guide a movement of the door 130 in the first direction, a rail assembly 140 may be provided between the body 10 and the door assembly 100 as shown in FIG. 1. The rail assembly 140 smoothly guides a sliding movement of the door 130 in the first direction. The rail assembly 140 is arranged at both sides of the door assembly 100 along the first direction, and includes a first rail 141 secured to the body 10 and a second rail 142 secured to the door assembly 100.

The first rail 141 is able to move with respect to the second rail 142 by sliding and vice versa. For a smooth sliding of the first and the second rails 141 and 142, a plurality of balls or rollers may be provided between the first and the second rails 141 and 142. The first rail 141 may be arranged on the second rail 142 and vice versa. Alternatively, the first rail 141 may be inserted into the second rail 142 and vice versa. Meanwhile, the rail assembly 140 may include three or more than three rails connected with each other.

Figure 3:
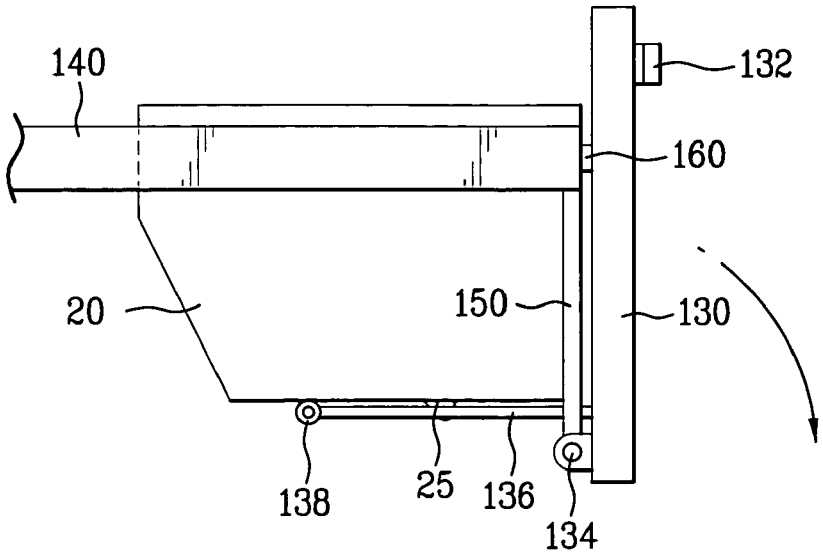
FIGS. 3 and 4 illustrate diagrams each showing a working mechanism of the door assembly for elevating the container when a door of the refrigerator is open.
Figure 4:
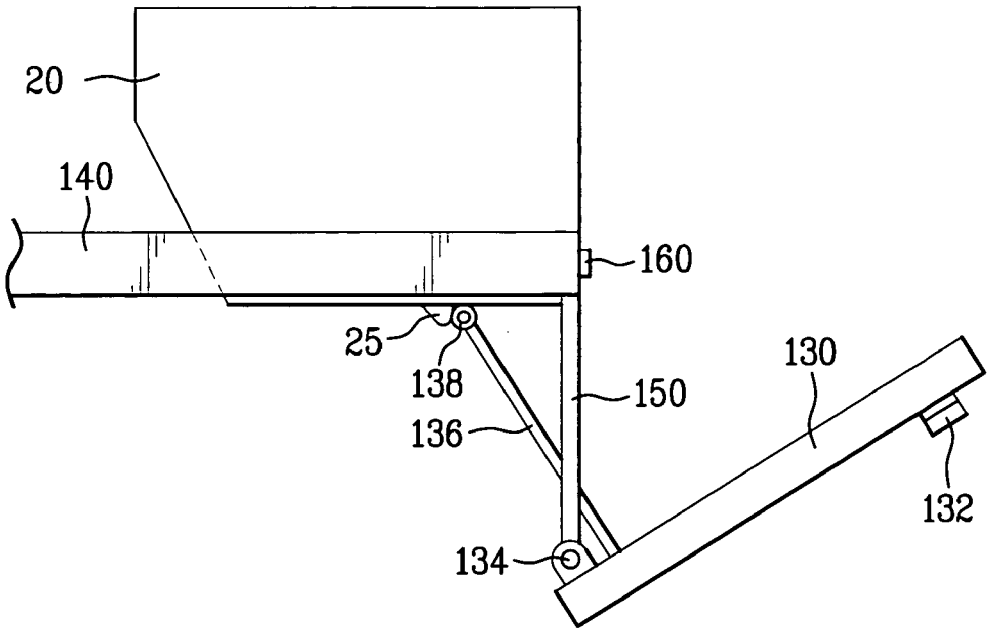

The door 130 rotates in a second direction in order to operate the lifting mechanism. The second direction may be a circular or curved direction. For example, an upper portion of the door 130 rotates downwardly about a lower portion of the door 130 when the door rotates along a second direction as shown in FIGS. 3 and 4 in order for the lifting mechanism to elevate the container 20.

As shown in FIG. 2, the lifting mechanism includes a hinge 134 allowing the door 130 to rotate in the second direction, and at least one lifting bar 136 supporting and elevating the container 20 disposed backside of the door 130 when the door 130 rotates about the hinge 134 in the second direction.

The hinge 134 is provided on the door 130. More particularly, the hinge may be provided on a rear surface of the door 130 and at the lower portion of the door 130. The hinge 134 directly or indirectly connects the door 130 with the rail assembly 140. For example, the hinge 134 may directly connect the lower portion of the door 130 with an end of the second rail 142. In this case, the rail assembly 140 may be horizontally arranged at a level with the lower portion of the door 130.

Alternatively, the hinge 134 may indirectly connect the lower portion of the door 130 with the end of the second rail 142. In this case, a frame 150 may be provided between the hinge 134 and the second rail 142. The frame 150 may include a first end and a second end. The first end is connected with an end of the rail assembly 140, especially the end of the second rail 142. The second end extends downwardly from the first end and is connected with the hinge 134. In this case, the rail assembly 140 may be arranged at a level with the upper portion of the door 130 as shown in FIG. 2. Alternatively, the rail assembly 140 may be arranged at a level with a middle portion of the door 130.

The frame 150 may merely connect the hinge 134 and the rail assembly 140 as shown in FIG. 2. However, a structure of the frame 150 is not limited to the above. For example, the frame 150 may have a structure which encompasses the container 20 except a bottom of the container 20 and a top of the container 20. In this case, the frame 150 may support the container 20 when the door assembly 100 is closed and may guide a vertical movement of the container 20 when the container 20 is elevated.

At least one lifting bar 136 is coupled to the door 130. More particularly, the lifting bars 136 extend toward the body 10 from the lower portion of the door 130. As shown in FIG. 2, two lifting bars 136 may be provided at a left side and a right side of the door 130. The lifting bars 136 may be parallel to the rail assembly 140 and to the bottom of the container 20.

The container 20 may be seated on and supported by the lifting bars 136 even when the door assembly 100 is closed. Alternatively, the container 20 may be seated on and supported by the frame which encompasses the container 20 except the bottom and the top of the container 20 when the door 130 is not yet rotated in the second direction.

The lifting bars 136 support the bottom of the container 20 when the door 130 rotates about the hinge 134 in the second direction after the door assembly 100 is open in order to elevate the container 20. Since the container 20 is lifted by the lifting bars 136 rotating along with the door 130 in the second direction, the highest level to which the container 20 is elevated is determined by a length of the lifting bars 136. Therefore, the length of the lifting bars 136 should be designed to take a volume of the container 20 and the highest level, and etc. into account.

A roller 138 may be provided at the lifting bars 136. More particularly, the roller 138 is provided at an end of each lifting bar 136. The roller 138 contacts with and rolls on the bottom of the container 20 when the door 130 rotates in the second direction to elevate the container 20. The roller 138 allows the container 20 to be smoothly lifted and prevents the bottom of the container 20 from being scratched by the lifting bars 136.

The door assembly 100 moves forward with respect to the body 10 when the user grabs a handle 132 on a front surface of the door 130 and pulls it. At this time, the force of the user acts on the door 130 in the first direction and a weight of the container 20 storing food therein acts on the lifting bars 136 in a downward direction. Therefore, the upper portion of the door 130 is contacted with the end of the rail assembly 100 or the frame 150, and the door 130 is not likely to rotate about the hinge 134 while the door assembly 100 moves in the first direction.

To enhance not only the user's convenience but also a reliability of the operation of the door assembly 100, the door assembly 100 may further include a limiter 160 selectively limiting a rotation of the door 130 in the second direction. The limiter 160 is provided at the rail assembly 140, more particularly, at the end of the second rail 142 as shown in FIGS. 3 and 4. Alternatively, the limiter 160 may be provided at the frame 150, more particularly, at an upper portion of the frame 150.

The limiter 160 may hold the door 130, especially, the upper portion of the door 130 when the door assembly 100 is closed and before the door assembly 100 is fully open to prevent the door 130 from rotating about the hinge 134 in the second direction. In addition, the limiter 160 may allow the door 130 to rotate about the hinge 134 in the second direction when the door assembly 100 is open and the door 130 is pulled by the user in the second direction.

In one embodiment, the limiter 160 may include a permanent magnet. It is preferable that the permanent magnet has an appropriate magnetic force which can hold the door 130, especially, the upper portion of the door 130, when the door 130 is horizontally pulled in the first direction and can release the door 130 when the door 130 is pulled downwardly in the second direction. However, it is inconvenient for the user in case that the magnetic force is too strong for the user to rotate the door 130 in the second direction. Therefore, the magnetic force of the permanent magnet should be determined, after taken the above mentioned facts into account.

In other embodiment, the limiter 160 may include an electromagnet. In this case, a conductor (not shown), for example, a power cable etc., may be provided between the electromagnet and the body 100. The conductor may be provided such that the conductor passes through the rail assembly 100. An electrical power may be supplied to the electromagnet except when the door assembly 100 is fully open. Then, the electromagnet holds the door 130, especially, the upper portion of the door 130, except when the door assembly 100 is fully open. The electrical power may not be supplied to the electromagnet when the door assembly 100 is fully open. Then, the electromagnet releases the door 130; thereby the user can easily rotate the door 130 about the hinge 134 in the second direction to elevate the container 20.

A projection 25 may be provided on the bottom of the container 20 as shown in FIGS. 3 and 4. The projection 25 is protruded downwardly from the bottom of the container 20 and has a slant surface thereon. The roller 138 on the lifting bar 136 rolls on the bottom of the container 20 in the first direction when the door 130 rotates about the hinge 134 in the second direction. At this time, the roller 138 rolls over the projection 25 when the container 20 is fully elevated. Then, the container 20 can be prevented from being fallen downwardly because the roller 138 is supported by the projection 25 and is prevented from rolling backward over the projection 25. When the door 130 is rotated in a direction contrary to the second direction by a strong force, the roller 130 rolls backward over the projection 25 and the container 20 moves downwardly.

The door assembly 100 according to an embodiment of the present invention operates as follows.

After grabbing the handle 132, the user pulls the door assembly 100 in the first direction. Then, the door assembly 100 and the container 20 move forward with respect to the body 10 of the refrigerator. At this time, the rail assembly 140 smoothly guides of the sliding movement of the door assembly 100 and the container 20. The limiter 160 holds the door 130 to prevent the door 130 from being rotated about the hinge 134 in the second direction.

The user rotates the door 130 about the hinge 134 in the second direction after the door assembly 100 is fully open. Then, the limiter 160 allows the door 130 to rotate; thereby the door 130 rotates about the hinge 134 in the second direction. While the door 130 rotates in the second direction, the lifting bars 136 elevate the container 20 as shown in FIG. 4. At this time, the roller 138 on the lifting bar 136 rolls on the bottom of the container 20 and reduces a friction between the lifting bars 136 and the bottom of the container 20.

When the door 130 is fully rotated, the container 20 is fully lifted. At this time, the roller 138 rolls over the projection 25 on the bottom of the container 20 and the projection 25 prevents the roller 138 from rolling backward. Thereby, the container 20 is prevented from falling downward while the user uses the container 20. After taking food out of or putting food into the container 20, the user rotates the door 130 in a direction contrary to the second direction. Then, the roller 138 rolls backward over the projection 25 and the container 20 moves downward.

After rotating the door 130 in the direction reverse the second direction, the user pushes the door assembly 100 toward the body 10 of the refrigerator. Then the door assembly 100 moves toward the body 100 along a direction reverse the first direction and eventually closes the freezing compartment 11.

In the above, an embodiment which the door assembly 100 moves forward and backward with respect to the body by guiding of the rail assembly 140 has been described. However, the present invention is not limited to the above. For example, the door assembly 100 may be coupled to the body 10 by a pivot like the door assembly 12. In this case, the user has to firstly rotate the door assembly 100 about the pivot so as to open the door assembly 100 and then secondly rotate the door 130 about the hinge 134 to elevate the container 20.

As it has been described, the refrigerator according to the present invention has the following advantages.

The refrigerator according to the present invention provides a lifting mechanism which enables the container in the compartment at the lower portion of the refrigerator to be elevated when the door is open. Therefore, it is not necessary that the user has to kneel down and bend over his or her body to take food from or put food into the container. Therefore, the refrigerator according to the present invention is very easy and convenient to be used.

In addition, the lifting mechanism has a very simple structure and has no driving unit such as a motor and gear assembly for elevating the container. Therefore, the cost of the fabrication of a refrigerator is reduced and mechanical troubles of the lifting mechanism are prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A door assembly for a refrigerator having a body, the door assembly comprising:

a door;

a rail assembly connectable with the body and connected to the door to guide a movement of the door in a first direction;

a frame connected with the rail assembly, the frame rotatably connected to the door so that the door rotates along a second direction; and a lifting mechanism supporting and elevating a container, wherein the lifting mechanism includes at least one lifting bar coupled to the door, the at least one lifting bar supporting and elevating the container when the door rotates along the second direction, and, wherein the lifting mechanism further includes a roller provided at the at least one lifting bar, the roller rolling on a bottom surface of the container when the door rotates in the second direction.

2. The door assembly of claim 1, wherein the lifting mechanism is spaced from and independent of the rail assembly and the frame.

3. The door assembly of claim 2, wherein the first direction is a horizontal direction.

4. The door assembly of claim 2, wherein an upper portion of the door rotates downwardly about a lower portion of the door when the door rotates along the second direction.

5. The door assembly of claim 2, wherein the lifting mechanism further includes:

a hinge connecting the door with the frame connected with the rail assembly, the hinge allowing the door to rotate in the second direction.

6. The door assembly of claim 5, wherein the frame includes:

a first end connected with an end of the rail assembly; and a second end extending downwardly from the first end, wherein the hinge is provided at the second end.

7. The door assembly of claim 5, wherein the container further includes a projection provided on a bottom thereof, the projection supporting the at least one lifting bar to prevent the container from falling downwardly when the container is fully elevated.

8. The door assembly of claim 5, wherein the hinge is connected with a lower portion of the door, further wherein an upper portion of the door is contacted with the rail assembly or the frame when the door moves in the first direction.

9. The door assembly of claim 2, further comprising a limiter selectively limiting a rotation of the door in the second direction.

10. The door assembly of claim 9, wherein the limiter allows the door to rotate in the second direction after the door is open.

11. The door assembly of claim 9, wherein the limiter includes a permanent magnet coupled to the rail assembly, the permanent magnet holding an upper portion of the door.

12. The door assembly of claim 9, wherein the limiter includes an electromagnet coupled to the rail assembly, the electromagnet releasing an upper portion of the door after the door is open.

13. A refrigerator comprising:

a body;

a compartment within the body;

a container within the compartment;

a door;

a rail assembly connected with the body and the door to guide a movement of the door in a first direction;

a frame connected with the rail assembly, the frame rotatably connected to the door so that the door rotates along a second direction; and a lifting mechanism supporting and elevating the container, wherein the lifting mechanism includes at least one lifting bar coupled to the door, the at least one lifting bar supporting and elevating the container when the door rotates along the second direction when the door is fully opened so that the lifting bar elevates the container, and wherein the lifting mechanism further includes a roller provided at the at least one lifting bar, the roller rolling on a bottom surface of the container when the door rotates in the second direction.

14. The refrigerator of claim 13, wherein the lifting mechanism is spaced from and independent of the rail assembly and the frame.

15. The refrigerator of claim 14, wherein the lifting mechanism further includes:

a hinge connecting the door with the frame connected with the rail assembly, the hinge allowing the door to rotate in the second direction.

16. The refrigerator of claim 15, wherein the container further includes a projection provided on a bottom thereof, the projection supporting the at least one lifting bars to prevent the container from falling downwardly when the container is fully elevated.

17. The refrigerator of claim 15, wherein the hinge is connected with a lower portion of the door, further wherein an upper portion of the door is contacted with the rail assembly or the frame when the door moves in the first direction.

18. The refrigerator of claim 14, further comprising a limiter selectively limiting a rotation of the door in the second direction.

19. The refrigerator of claim 15, further comprising a magnet coupled to the rail assembly or the frame, the magnet holding an upper portion of the door.

20. The refrigerator of claim 19, wherein the first direction is a horizontal direction and the second direction is a circular direction.

* * * * *